US005333354A

United States Patent [19]

Takemoto et al.

[11] Patent Number: 5,333,354

[45] Date of Patent: Aug. 2, 1994

[54] DEVICE FOR COLLECTING DUST AS FIBER WASTE AND THE LIKE ON CREEL STAND

[75] Inventors: Sumio Takemoto; Kiyoshi Hayaski, both of Hyogo, Japan

[73] Assignee: Precision Fukuhara Works, Ltd., Japan

[21] Appl. No.: 869,305

[22] Filed: Apr. 16, 1992

[30] Foreign Application Priority Data

Apr. 19, 1991 [JP] Japan ..... 3-116850

[51] Int. Cl.[5] ..... B65H 49/14

[52] U.S. Cl. ..... 15/301; 15/316.1; 15/346; 57/304; 242/131.1

[58] Field of Search ..... 15/301, 316.1, 345, 15/346; 242/131.1; 57/304

[56] References Cited

U.S. PATENT DOCUMENTS 3,071,918 1/1963 Hofstetter ..... 57/304
3,667,093 6/1972 Culpepper ..... 15/301 X
4,333,201 6/1982 Rohner ..... 15/301
4,551,927 11/1985 Shelton ..... 57/304 X
4,784,349 11/1988 Renwick et al. ..... 15/301 X
4,903,367 2/1990 Brunner ..... 15/301
4,948,067 8/1990 Gutschmit ..... 15/301 X

FOREIGN PATENT DOCUMENTS 3139608 4/1983 Fed. Rep. of Germany .
3833434 12/1989 Fed. Rep. of Germany .
2353328 12/1977 France .

*Primary Examiner*—Chris K. Moore
*Attorney, Agent, or Firm*—Bell, Seltzer, Park & Gibson

[57] ABSTRACT

A fan located in a lower part of an inner section of the creel stand creates an air flow that extends upwardly through a cylindrical duct to a ceiling plate of the creel stand. The air then passes radially outwardly, and thence downwardly through an outer section of the creel stand to filters adjacent the bottom of the stand. One of the filters undergoes rotary movement, and fiber waste is conducted from it to a collection source by a suction device.

12 Claims, 4 Drawing Sheets

DEVICE FOR COLLECTING DUST AS FIBER WASTE AND THE LIKE ON CREEL STAND

FIELD OF THE INVENTION

This invention relates to an apparatus for collecting lint, dust and similar material, hereinafter referred to as fiber waste, from a creel stand associated with a knitting machine, and for thereby improving the environmental conditions in a knitting plant or factory.

BACKGROUND OF THE INVENTION

The number of yarn bobbins mounted upon the creel stand associated with a knitting machine may number from about 30 to over 100. The quantity of fiber waste discharged from the yarn passing to and from the creel stand is therefore quite large, particularly when the yarn is comprised of cotton. After the fiber waste has become airborne, it will tend to settle upon and adhere to spare bobbins or yarns that are to be pieced together, thereby causing yarn breakage and defects in the fabric being knitted. This of course lowers the quality of the fabric, and also impairs the efficiency of the knitting operation.

It has previously been proposed to direct a current of air downwardly from a fan or blower located above the creel stand. This approach is of little benefit, however, since the air flow merely temporarily displaces the fiber waste, and does not collect the same or prevent its migration to adjacent creel stands and/or knitting machines.

It has also heretofore been proposed to enclose the creel stand by a hermetic covering, and to then collect the fiber waste by use of a motor driven fan and waste-collecting filters disposed within the hermetic covering. However, providing a hermetic covering is quite costly, and its presence complicates the knitting operation.

SUMMARY OF THE INVENTION

The present invention provides a relatively simple and inexpensive apparatus for efficiently removing and collecting fiber waste from a creel stand, as a result of which the environment in the knitting plant or factory is cleaner, yarn breakage and defects in the knitted fabric are reduced, and the productivity and quality of the knitting process and the knitted fabric are improved.

In a preferred embodiment, the fiber waste collecting apparatus of the invention includes a rotatable first filter means mounted in an inner central section of the creel stand; air suction and blowing means situated at an elevation and location adjacent the first filter means; a cylindrical exhaust duct located above the air suction and blowing means; a ceiling plate atop the creel stand; a second filter in an outer section of the creel stand; and drive means for rotating the first filter means.

The air flow produced by the suction and blowing means associated with the first filter means passes upwardly through the inner section of the creel stand, and is then directed downwardly through the outer section of the creel stand. The air then passes to the filter means in the lower part of the creel stand.

A small ceiling plate capable of being opened and closed is preferably provided on part of the large ceiling plate, for the purpose of controlling the force of the air current.

During operation of the fiber waste collecting apparatus, a motor driven fan of the suction and blowing means creates an air current on its exhaust or downstream side that passes upwardly in the central section of the creel stand, then outwardly, and then downwardly through the outer section of the stand. The downwardly directed air current entrains fiber waste emerging from the yarn bobbins supported by the creel stand, and fiber waste emerging from the yarn guiding pipe associated with the creel stand. The downwardly conducted fiber waste adheres to the surface of the first filter means, to which it is attracted by the suction action of the motor driven fan. The fiber waste adhering to the first filter is removed and collected as the filter rotates past a suction nozzle adjacent such filter.

DESCRIPTION OF THE DRAWINGS

Other features of the invention will be apparent from the following description of an illustrative embodiment thereof, which should be read in conjunction with the accompanying drawings, in which.

DESCRIPTION OF THE ILLUSTRATED EMBODIMENTS

Figure 1:
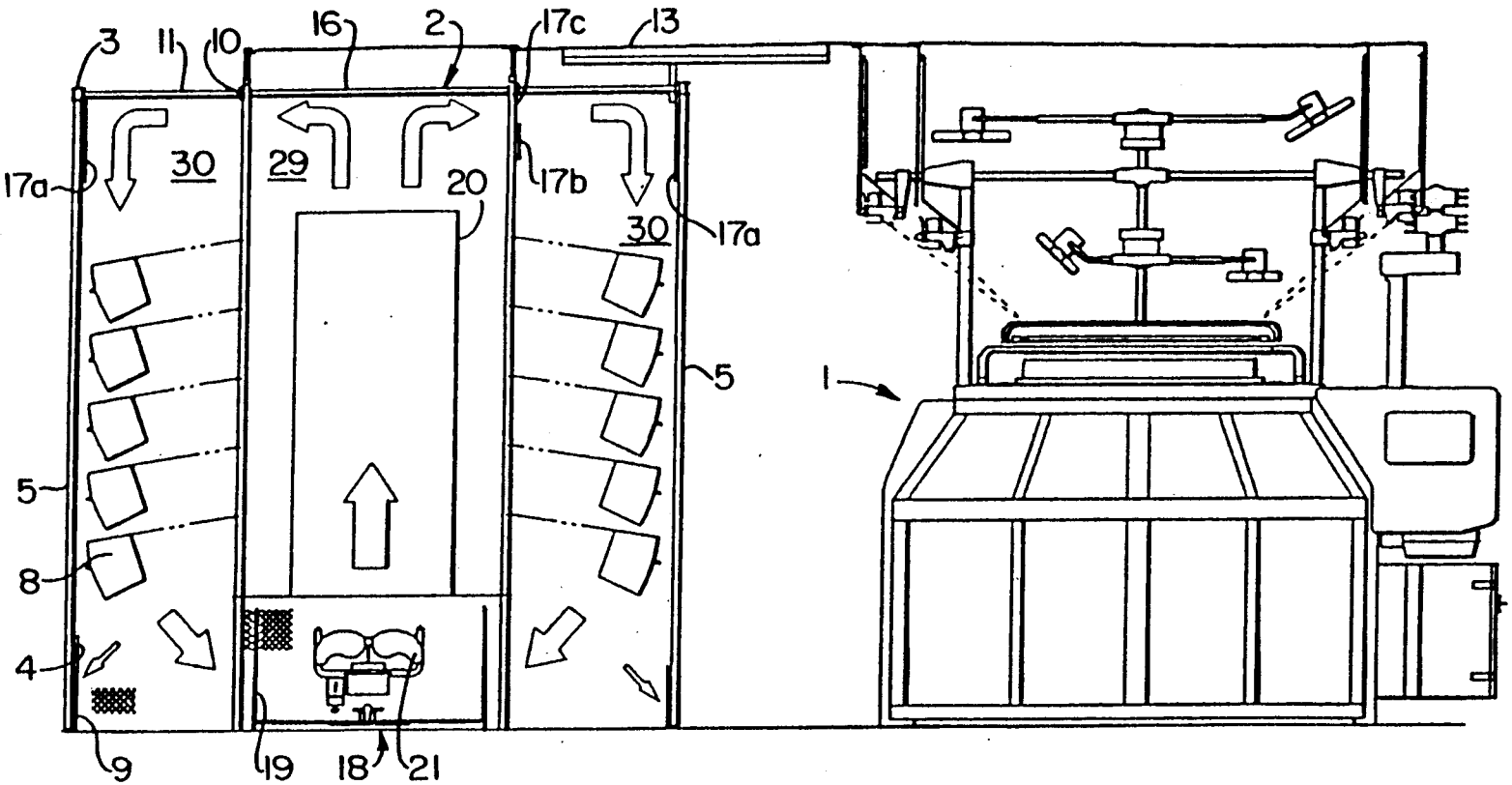
FIG. 1 is a view partially in front elevation and partially in vertical section of an apparatus for collecting fiber waste from a creel stand associated with a circular knitting machine.
Figure 6:
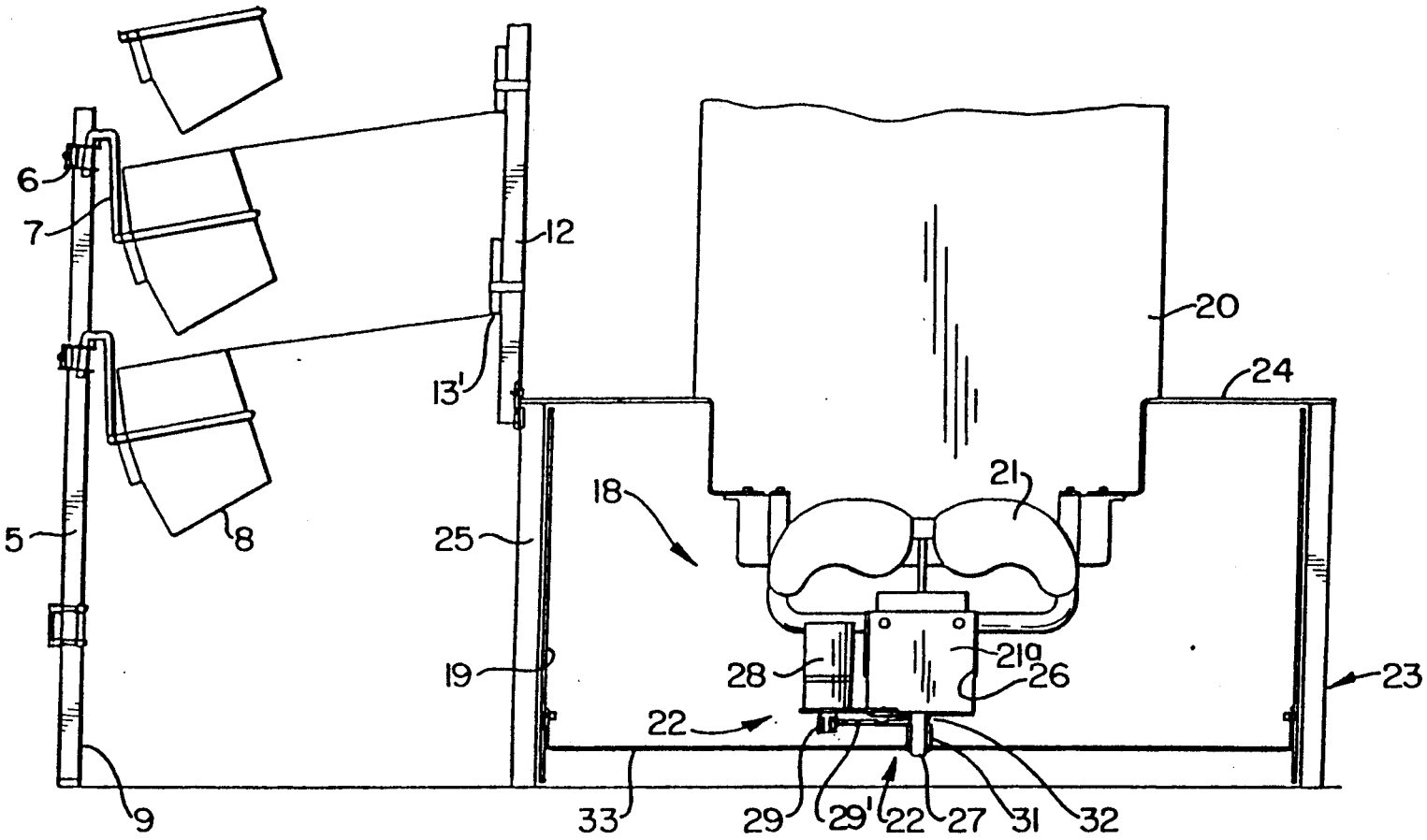
FIG. 6 is an enlarged view, partially in elevation and partially in vertical section, of fiber waste collecting components and adjacent components of the creel stand.

Referring more particularly to the drawings, FIG. 1 shows a circular knitting machine 1 having a large number of yarn feeding members to which yarn is supplied from a laterally adjacent creel stand 2. Creel stand 2 has large diameter rings 3 and 4 adjacent its upper and lower ends, respectively. The height of stand 2 is illustratively about 1.9 meters, and the height of rings 3 and 4 is illustratively about 500 mm. A plurality of elongate support members 5 overlie the outer surfaces of rings 3, 4 and extend between such rings in generally parallel relationship to the central axis of creel stand 2. As is best shown in FIG. 6, bobbin holders 6 are secured to each support member 5 with screws or the like, and a yarn bobbin 8 is mounted upon the stem 7 of each holder 6.

Figure 5:
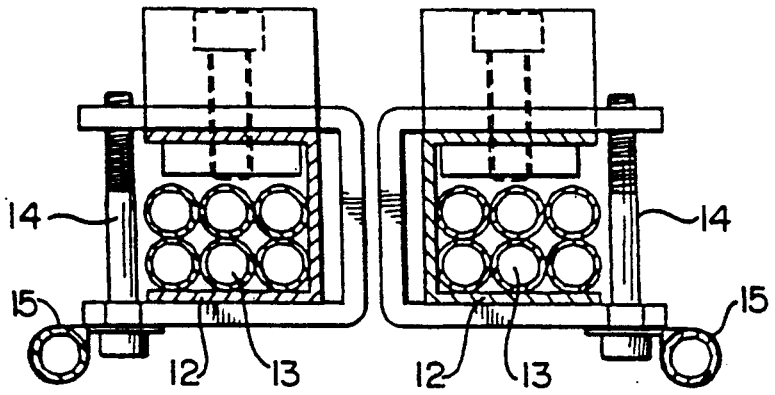
FIG. 5 is an enlarged view, partially in elevation and partially in section, of channel members and yarn guiding pipes secured therein.

Creel stand 2 further includes a smaller diameter ring 10 that is concentric with and spaced radially inwardly from ring 3. Rings 3 and 10 are connected to each other by horizontal members 11 that extend radially toward the axial center of the creel stand. A plurality of channel members 12 (FIGS. 2 and 5) are connected to and located at equal intervals around the exterior of ring 10, in parallel relationship with the central axis of the stand. As shown in FIG. 5, each channel member 12 receives a plurality of yarn guiding pipes 13. A bolt 14 adjacent the open side of each channel member 12 prevents lateral movement of pipes 13. Each bolt 14 has a band 15 secured to one of its ends for causing pipes 13 to face bobbins 8. An eyelet 13' (FIG. 6) made of porcelain or the like is secured in the outlet or tip part of each yarn guiding pipe 13. The yarn unwound from a bobbin 8 is guided to one of the eyelets 13', and thence to knitting machine 1 after passing through yarn guiding pipe 13.

The upper portion of creel stand 2 further includes outer and inner partitions 17*a*, 17*b*, respectively, and a ceiling plate 16 which define air flow controlling means. A soft air impermeable vinyl sheet or other shielding member (not shown) covers ceiling plate 16 and part of outer partition 17*a*. Outer partition 17*a* is located at an elevation above that of the uppermost yarn bobbin 8, and illustratively has a vertical dimension of about 500 mm. Inner partition 17*b* is spaced downwardly from ceiling plate 16 so as to provide an opening 17*c* permitting air currents to pass from an inner section 29 of stand 2 into an outer stand section 30 within which are located yarn supplying bobbins 8. A filter member 9 may be and illustratively is also located within the lower part of outer stand section 30 for removing fiber waste from any air escaping from the lower portion of outer section 30.

Figure 3:
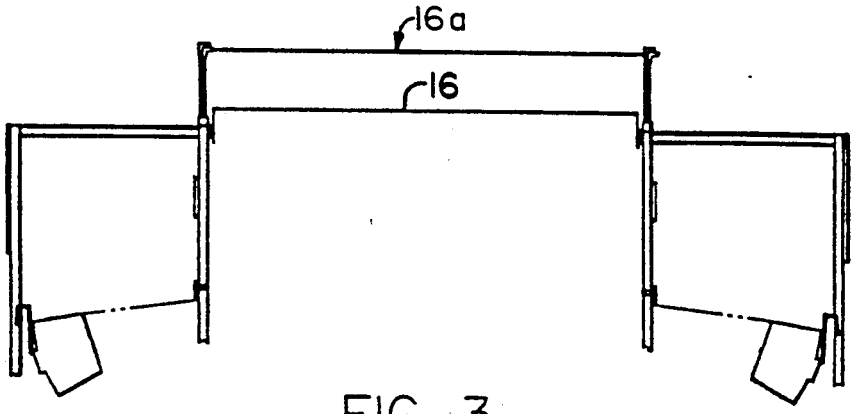
FIG. 3 is an enlarged fragmentary elevational view of the upper portion of the creel stand of FIG. 1.
Figure 4:
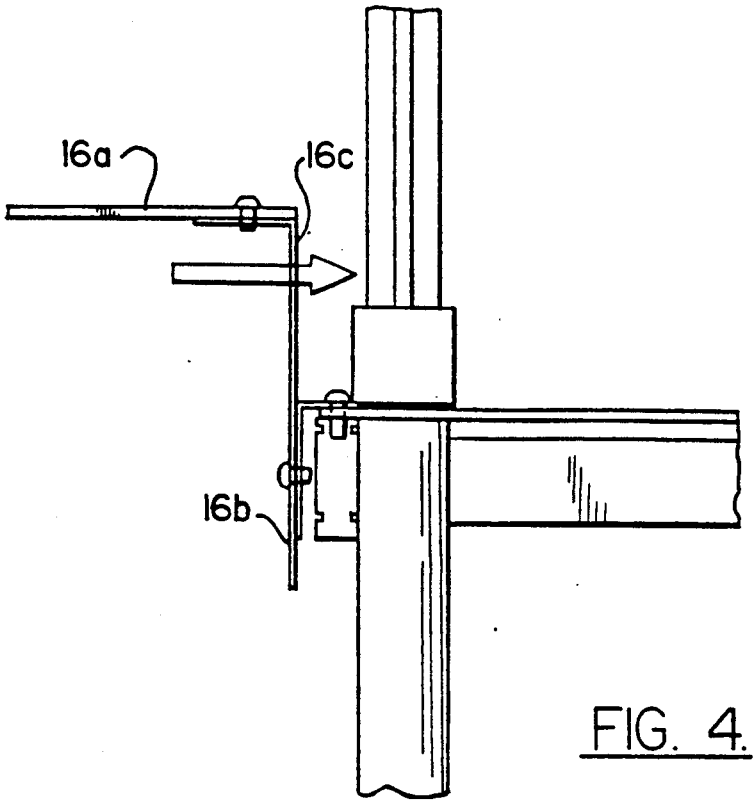
FIG. 4 is an enlarged fragmentary view, partially in vertical section and partially in elevation, of ceiling plate and adjacent components of the creel stand.

Referring now particularly to FIGS. 3 and 4, a small ceiling plate 16*a* forms the central portion of large ceiling plate 16 and is movable vertically between open and closed positions for the purpose of regulating the force of the air currents in stand section 29. Upward adjustive movement of plate 16*a* discharges air laterally from the space 16*c* (FIG. 4) when the air current within stand section 29 is too strong. When small ceiling plate 16*a* is capable of being opened and closed, as shown, a plurality of support members 16*b* (FIG. 4) are provided between it and ceiling plate 16.

Referring now particularly to FIGS. 1 and 6, a fiber waste removing and collecting apparatus 18 located within the central inner section 29 of creel stand 2 includes a filter 19, an exhaust duct 20, a motor driven fan 21, and a drive assembly 22 for rotating filter 19. While duct 20 is illustratively of cylindrical shape, it might instead be of square or oblong polygonal shape. Duct 20 is bolted or otherwise fixedly secured to a stepped section 24 of a circular frame 23 having a diameter greater than that of the duct. The height and diameter of duct 20 are illustratively about 1.4 m and 0.6 m, respectively. A plurality of legs 25 are secured to the side of frame 23. Fan 21 is secured below duct 20 to frame 23 and has its exhaust or air discharge side uppermost. If desired, a space may be provided between exhaust duct 20 and section 24 of frame 23, and the exhaust duct may be of generally conical shape, i.e., it may have a larger diameter at its lower part and a smaller diameter at its upper part.

Drive means 22 for rotating filter 19 is disposed adjacent motor 21*a* of fan 21. The drive means includes a vertical shaft 27 and a gear motor 28 that are secured by a bracket 26 to motor 21*a* of fan 21. Motor 28 operates at preselected time intervals and at preselected low speeds in accordance with the variable setting of a timer device (not shown). Operation of motor 28 imparts rotation to a pulley 35 upon the end of the drive shaft of motor 28. Rotation of pulley 35 in turn imparts rotation, via a belt 35', to a pulley 32 integral with a bearing 31 upon stationary shaft 27 of motor 21*a*.

Four arms 33 are secured by snap rings or any other suitable fasteners to pulley 32 and extend radially outwardly from the pulley and from shaft 27. Upturned outer end portions 33*a* of arms 33 support and are secured to filter 19. The height of filter 19 is illustratively about 0.5 m and only slightly less than the height of circular ring 3. The filter may be formed of a plurality of sections that are connected together, and has a plurality of holes extending through its outer wall. There preferably are about 20–40 holes per square inch, and more preferably are about 30 holes per square inch. In lieu of a filter, a metallic net or perforated steel sheet having equivalent holes may be employed.

When fan 21 is energized it causes air to flow upwardly through and from duct 20 as is indicated in FIG. 1 by the upwardly pointing arrow depicted in the central part of the creel stand 2. Upon reaching an elevation adjacent ceiling plate 16 the air flows radially outwardly, via the space 17*c* between the ceiling plate and ring, to outer section of stand 2. Part of such air then flows downwardly along inner partition 17*b*, while another part of the air flows downwardly along outer partition 17*a*. As a result of the foregoing, fiber waste emanating from bobbins 8 and eyelets 13' of yarn guiding pipes 13 is conveyed downwardly by the downward air current. Part of the downwardly conveyed fiber waste adheres to filter 19, and other of the fiber waste adheres to the outwardly disposed filter 9.

Figure 2:
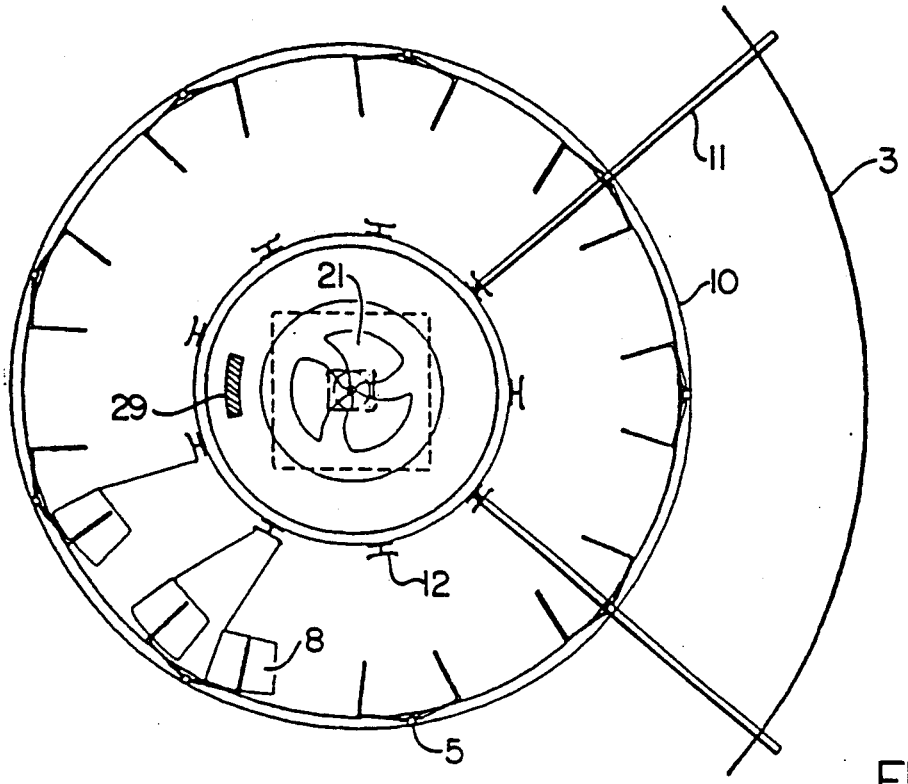
FIG. 2 is a fragmentary top plan view of the circular creel stand of FIG. 1.

The fiber waste adhering to filter 19 is removed from it by a suction head 36 of a suction unit (not otherwise shown) schematically shown in FIG. 2 positioned adjacent the path of rotary movement of filter 19. Fiber waste may alternatively be removed from filter 19 by moving the suction head of the filter unit along the filter surface to which the fiber waste adheres. Other fiber waste stripping means (not shown) may also be provided for stripping fiber waste from the area between filters 9 and 19, if desired.

When the creel stand is of a type upon which the bobbins are linearly arranged, a filter of flat shape instead of circular shape may be employed.

While preferred embodiments of the invention have been shown and described, this was for purposes of illustration only, and not for purposes of limitation, the scope of the invention being in accordance with the following claims.

We claim:

1. Apparatus for collecting fiber waste from a creel stand having a substantially empty inner section and an outer section containing yarn bobbins and yarn guiding means;

filter means mounted for rotation in the lower portion of said inner section of said creel stand;

air suction and blowing means located in said inner section adjacent said filter means for blowing air upwardly in the inner section of the creel stand and for creating a suction on said filter means;

an exhaust duct located in said inner section of said creel stand above said air suction and blowing means for directing the upwardly blowing air to the top of the creel stand;

a ceiling plate adjacent the top of said creel stand above said exhaust duct and in the path of the air passing through said exhaust duct, said ceiling plate substantially blocking further upward movement of the air and changing the direction of air currents passing upwardly through said inner section to said ceiling plate to cause the air currents to move outwardly into the outer section of the creel stand;

drive means for imparting rotation to said filter means; and means located around the upper portion of the outer section of the creel stand at an elevation substantially above that of the uppermost yarn bobbins for blocking further outward movement of the air and causing the air to flow downwardly across bobbins and yarn guiding means in the outer section to said filter means.

2. Apparatus as in claim 1, and wherein said ceiling plate includes a ceiling plate portion being adjustably movable relative to the remainder of said ceiling plate for controlling the force of the air flow within said creel stand.

3. Apparatus as in claim 1, and further including second filter means in said outer section of said creel stand.

4. In a creel stand for a circular knitting machine having an inner section and an outer section located outwardly of said inner section, said outer section having yarn supplying and guiding means which generate fiber waste during operation of the circular knitting machine and creel stand, the combination therewith of apparatus for removing and collecting fiber waste from the creel stand comprising:

(a) air suction and blowing means located in the lower portion of said inner section of said creel stand for blowing high velocity air upwardly within said inner section of said creel stand and for creating a suction in the lower portion of said inner section of said creel stand;

(b) duct means located in the inner section of said creel stand above said air suction and blowing means for confining and directing the upwardly blowing air from said air suction and blowing means to the upper portion of the inner section of said creel means;

(c) first air flow controlling means located in the upper portion of the inner section of said creel stand above said duct means for substantially blocking further upward movement of upwardly blowing air and for directing such air from the inner section into the outer section of said creel stand;

(d) second air flow controlling means located in the upper portion of the outer section of said creel stand above said yarn supplying means for substantially blocking further outward movement of such blowing air and for directing such air downwardly within the outer section of said creel stand and across said yarn supplying and guiding means to remove fiber waste therefrom; and (e) filter means located in the lower portion of the inner section of said creel stand between said air suction and blowing means and the outer section of said creel stand for removing fiber waste from air currents being sucked into said air suction and blowing means.

5. A creel stand as in claim 4, and further including a second filter located within said outer section of said stand.

6. A creel stand according to claim 4, wherein said creel stand is generally cylindrical and said outer section surrounds said inner section thereof.

7. A creel stand according to claim 6, wherein said filter means is generally cylindrical and surrounds said air suction and blowing means.

8. A creel stand according to claim 7, wherein said filter means is mounted for rotation, and including drive means for rotating said filter means, and a suction nozzle for cleaning collected fiber waste from said filter means.

9. A creel stand as in claim 8, and further including a suction nozzle adjacent said filter means for removing fiber waste from said filter means.

10. A creel stand according to claim 4, wherein said first air flow controlling means includes means for controlling the force of air flow from the inner section of said creel stand into the outer section thereof.

11. Apparatus for collecting fiber waste from a creel stand having an inner section and an outer section;

filter means mounted for rotation in the lower portion of said inner section of said creel stand;

air suction and blowing means located in said inner section adjacent said filter means for blowing air upwardly in the inner section of the creel stand and for creating a suction on said filter means;

an exhaust duct located in said inner section of said creel stand above said air suction and blowing means for directing the upwardly blowing air to the top of the creel stand;

a ceiling plate adjacent the top of said creel stand above said exhaust duct and in the path of the air passing through said exhaust duct, said ceiling plate substantially blocking further upward movement of the air and changing the direction of air currents passing upwardly through said inner section to said ceiling plate to cause the air currents to move outwardly into the outer section of the creel stand;

drive means for imparting rotation to said filter means; and said ceiling plate including a ceiling plate portion adjustably movable relative to the remainder of said ceiling plate for controlling the force of the air flow within said creel stand.

12. Apparatus for collecting fiber waste from a creel stand having an inner section and an outer section;

filter means mounted for rotation in the lower portion of said inner section of said creel stand;

air suction and blowing means located in said inner section adjacent said filter means for blowing air upwardly in the inner section of the creel stand and for creating a suction on said filter means;

an exhaust duct located in said inner section of said creel stand above said air suction and blowing means for directing the upwardly blowing air to the top of the creel stand;

a ceiling plate adjacent the top of said creel stand above said exhaust duct and in the path of the air passing through said exhaust duct, said ceiling plate substantially blocking further upward movement of the air and changing the direction of air currents passing upwardly through said inner section to said ceiling plate to cause the air currents to move outwardly into the outer section of the creel stand;

drive means for imparting rotation to said filter means; and second filter means in said outer section of said creel stand.

* * * * *

UNITED STATES PATENT AND TRADEMARK OFFICE

CERTIFICATE OF CORRECTION

PATENT NO. : 5,333,354

DATED : August 2, 1994

INVENTOR(S) : Takemoto et al.

It is certified that error appears in the above-identified patent and that said Letters Patent is hereby corrected as shown below:

On the title page, item: [56], the following references were omitted, but should appear thereon as follows:

| | | |
|---|---|---|
| 4,874,411 | 10/1989 | Snauwaert et al. |
| 4,881,957 | 11/1989 | Shofner |
| 4,922,691 | 5/1990 | Shen |
| 0 389 045 | 9/1990 | European Patent Office |

"Shelton Launch The Filtafan"; Filiere Maille, September/October 1989

Shelton Filtafan Creel Leaflet

Portion of Article in NY Fabric Journal, 1989

Signed and Sealed this

Third Day of January, 1995

Bruce Lehman

*Attest:*

BRUCE LEHMAN

*Attesting Officer*

*Commissioner of Patents and Trademarks*